US009460681B2

(12) United States Patent
Hwang et al.

(10) Patent No.: US 9,460,681 B2
(45) Date of Patent: Oct. 4, 2016

(54) DISPLAY DEVICE AND DRIVING CIRCUIT THEREOF FOR IMPROVING THE ACCURACY OF GAMMA TUNING

(71) Applicant: Samsung Display Co., Ltd., Yongin, Gyeonggi-Do (KR)

(72) Inventors: Hyun-Sik Hwang, Yongin (KR); Joon-Chul Goh, Yongin (KR); Won-Sik Oh, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/550,635

(22) Filed: Nov. 21, 2014

(65) Prior Publication Data

US 2015/0145898 A1 May 28, 2015

(30) Foreign Application Priority Data

Nov. 25, 2013 (KR) ..... 10-2013-0143832

(51) Int. Cl.
*G09G 3/36* (2006.01)

(52) U.S. Cl.
CPC ..... *G09G 3/3688* (2013.01); *G09G 3/3607* (2013.01); *G09G 3/3614* (2013.01); *G09G 2300/0443* (2013.01); *G09G 2310/027* (2013.01); *G09G 2310/08* (2013.01); *G09G 2320/0276* (2013.01); *G09G 2320/0673* (2013.01)

(58) Field of Classification Search
None
See application file for complete search history.

(56) References Cited

U.S. PATENT DOCUMENTS

| | | | | |
|---|---|---|---|---|
| 2007/0013621 | A1* | 1/2007 | Lee et al. | 345/82 |
| 2007/0195047 | A1* | 8/2007 | Cho | 345/98 |
| 2007/0285589 | A1 | 12/2007 | Song | |
| 2008/0122814 | A1* | 5/2008 | Shin et al. | 345/204 |
| 2008/0136761 | A1* | 6/2008 | Hong et al. | 345/89 |
| 2009/0316050 | A1 | 12/2009 | Sahu et al. | |
| 2010/0007639 | A1* | 1/2010 | Jeong et al. | 345/208 |
| 2012/0162208 | A1* | 6/2012 | Park et al. | 345/419 |
| 2013/0147781 | A1* | 6/2013 | Kim et al. | 345/211 |
| 2013/0147861 | A1* | 6/2013 | Kim et al. | 345/690 |
| 2015/0170609 | A1* | 6/2015 | Jung | 345/212 |

FOREIGN PATENT DOCUMENTS

| | | | |
|---|---|---|---|
| KR | 10-2004-0061519 | A | 7/2004 |
| KR | 10-2006-0135365 | A | 12/2006 |
| KR | 10-2007-0101502 | A | 10/2007 |
| KR | 10-2008-0010007 | A | 1/2008 |
| KR | 10-2011-0031162 | A | 3/2011 |

* cited by examiner

*Primary Examiner* — David D Davis
(74) *Attorney, Agent, or Firm* — Knobbe Martens Olson & Bear LLP

(57) ABSTRACT

A display device and a driving circuit thereof are disclosed. In one aspect, the display device includes a display panel, a gamma reference voltage generator, a data driver and a driving controller. The display panel includes a plurality of pixels, each pixel including first and second sub-pixels. The gamma reference voltage generator generates one or more first gamma reference voltages each having a high gamma value greater than a reference gamma value, and one or more second gamma reference voltages each having a low gamma value less than the reference gamma value. The data driver generates a data voltage based at least in part on one or more of the first and second gamma reference voltages, and provides the data voltage to the first and second sub-pixels. The driving controller determines a gamma value and a data voltage output pattern according to a driving method of the display panel.

19 Claims, 7 Drawing Sheets

FIG. 4A
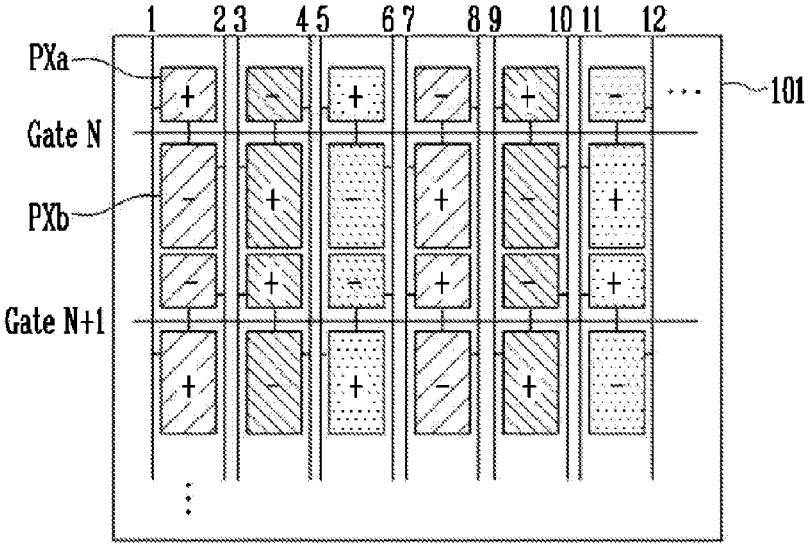
FIG. 4B
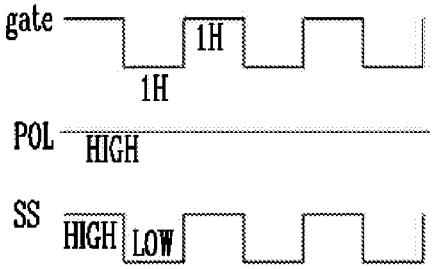
FIG. 4C
(SSC=11)
| POL | SS | D1 | D2 | D3 | D4 | ... |
|---|---|---|---|---|---|---|
| H | H | (+)High Gamma | (−)Low Gamma | (+)Low Gamma | (−)High Gamma | ... |
| H | L | (+)Low Gamma | (−)High Gamma | (+)High Gamma | (−)Low Gamma | ... |
| H | H | (+)High Gamma | (−)Low Gamma | (+)Low Gamma | (−)High Gamma | ... |
| H | L | (+)Low Gamma | (−)High Gamma | (+)High Gamma | (−)Low Gamma | ... |
| ... | ... | ... | ... | ... | ... | ... |

FIG. 5A
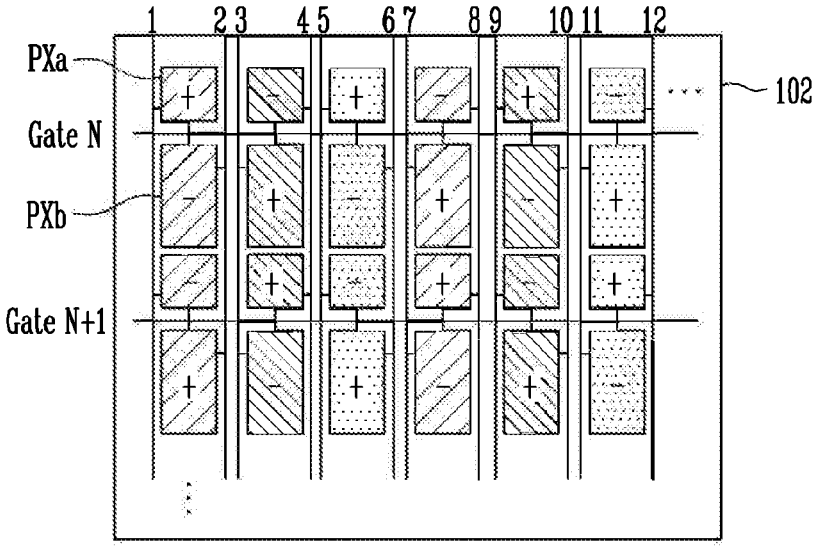
FIG. 5B
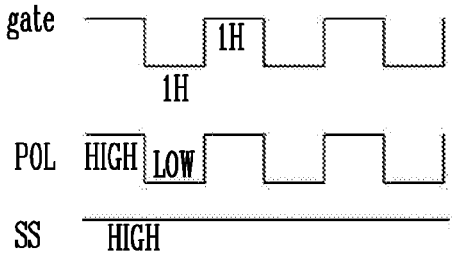
FIG. 5C
(SSC=11)
| POL | SS | D1 | D2 | D3 | D4 | ... |
|---|---|---|---|---|---|---|
| H | H | (+)High Gamma | (−)Low Gamma | (+)Low Gamma | (−)High Gamma | ... |
| L | H | (−)High Gamma | (+)Low Gamma | (−)Low Gamma | (+)High Gamma | ... |
| H | H | (+)High Gamma | (−)Low Gamma | (+)Low Gamma | (−)High Gamma | ... |
| L | H | (−)High Gamma | (+)Low Gamma | (−)Low Gamma | (+)High Gamma | ... |
| ... | ... | ... | ... | ... | ... | ... |

FIG. 6A
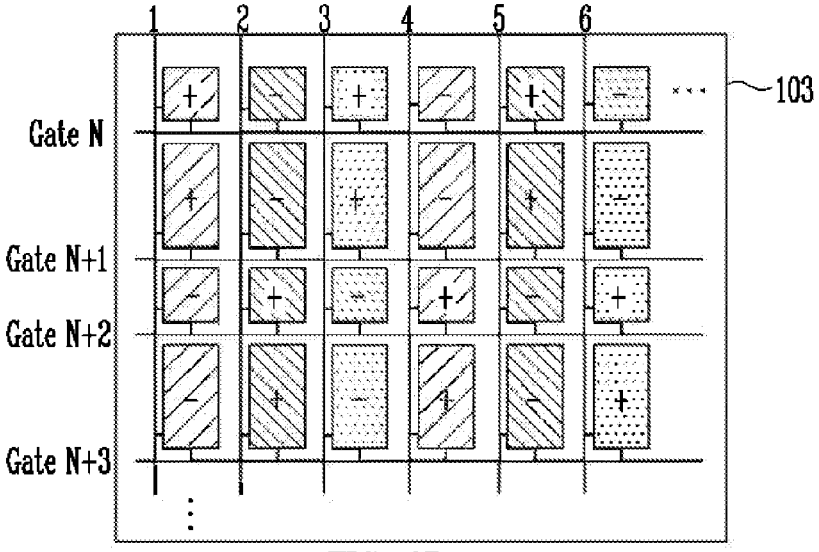
FIG. 6B
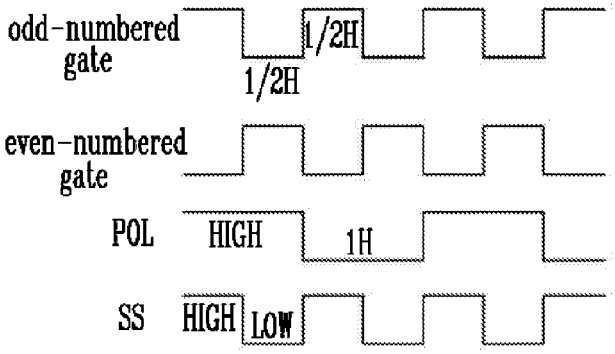
FIG. 6C
(SSC=00)
| POL | SS | D1 | D2 | D3 | D4 | ... |
|---|---|---|---|---|---|---|
| H | H | (+)High Gamma | (−)High Gamma | (+)High Gamma | (−)High Gamma | ... |
| H | L | (+)Low Gamma | (−)Low Gamma | (+)Low Gamma | (−)Low Gamma | ... |
| L | H | (−)High Gamma | (+)High Gamma | (−)High Gamma | (+)High Gamma | ... |
| L | L | (−)Low Gamma | (+)Low Gamma | (−)Low Gamma | (+)Low Gamma | ... |
| ... | ... | ... | ... | ... | ... | ... |

DISPLAY DEVICE AND DRIVING CIRCUIT THEREOF FOR IMPROVING THE ACCURACY OF GAMMA TUNING

CROSS-REFERENCE TO RELATED APPLICATIONS

This application claims priority to and the benefit of Korean Patent Application No. 10-2013-0143832, filed on Nov. 25, 2013, in the Korean Intellectual Property Office, the entire contents of which are incorporated herein by reference in their entirety.

BACKGROUND

1. Field

The described technology generally relates to a display device and a driving circuit thereof.

2. Description of the Related Technology

A liquid crystal display (LCD) is a display device in which an electric field is applied to a liquid crystal material having an anisotropic dielectric constant. The liquid crystal material is injected between a color filter substrate and an array substrate having thin film transistors (TFT) formed thereon. The amount of light transmitted through the substrate is adjusted by controlling the intensity of the electric field, thereby displaying an image.

In LCDs, there is a technique in which one pixel is divided into two sub-pixels. A data voltage having a high gamma value (hereinafter, referred to as a high data voltage) and a data voltage having a low gamma value (hereinafter, referred to as a low data voltage) are respectively applied to the two sub-pixels so that the arrangement directions of liquid crystal molecules in the two sub-pixels are different, thereby improving the visibility from left and right viewing angles.

Specifically, in a 2G1D structure in which gate lines are respectively electrically connected to two sub-pixels and a common data line is electrically connected to the two sub-pixels, the high and low data voltages are alternately applied to the two sub-pixels. In a 1G2D structure in which a common gate line is electrically connected to two sub-pixels and data lines are respectively electrically connected to the two sub-pixels, the two sub-pixels can be charged substantially at the same time. Therefore, voltage swing generally does not occur, and a gamma value is adjusted by converting an image data.

SUMMARY OF CERTAIN INVENTIVE ASPECTS

One inventive aspect is a display device. The display device includes a display panel configured with a plurality of pixels each including first and second sub-pixels. The display device also includes a gamma reference voltage generator configured to supply first gamma reference voltages having a high gamma value greater than a reference gamma value, and second gamma reference voltages having a low gamma value smaller than the reference gamma value. The display device further includes a data driver configured to selectively output, to the first and second sub-pixels, a data voltage generated based on any one of the first gamma reference voltages and the second gamma reference voltages. Furthermore, the display device includes a driving controller configured to determine the gamma value and output pattern of the data voltage according to a driving method of the display panel.

The gamma reference voltage generator may include a first gamma reference voltage generator configured to generate the first gamma reference voltages from a first driving voltage, and a second gamma reference voltage generator configured to generate the second gamma reference voltages from a second driving voltage.

The first and second driving voltages may have the same voltage level.

The first gamma reference voltages may correspond to inflection points of a high gamma curve, and the second gamma reference voltages may corresponding to inflection points of a low gamma curve.

The reference gamma value may be 2.2.

The data driver may include a voltage dividing unit configured to generate a plurality of gray scale voltages by voltage-dividing the first and second gamma reference voltages.

The first and second gamma reference voltages may be divided positive and negative gamma reference voltages. The plurality of gray scale voltages may include positive first gray scale voltages generated from positive first gamma reference voltages, negative second gray scale voltages generated from negative first gamma reference voltages, positive third gray scale voltages generated from positive second gamma reference voltages, and negative fourth gray scale voltages generated from negative second gamma reference voltages.

The voltage dividing unit may include first to fourth R-strings configured to generate the first to fourth gray scale voltages.

The data driver may include a gray scale voltage selection unit configured to select and output at least one of the first to fourth gray scale voltages according to a data driving control signal of the driving controller.

The data driving control signal may include a polarity inversion signal configured to select the polarity of the data voltage, a swap signal configured to select the gamma value of the data voltage, and a pattern control signal configured to select the output pattern of the data voltage.

The gray scale voltage selection unit may include a lookup table in which an output pattern of the gray scale voltages corresponding to combinations of the swap signal and the pattern control signal is listed.

The data driver may include a digital-analog converter (DAC) unit configured to generate an analog data voltage corresponding to a digital image data, based on the gray scale voltages supplied from the gray scale voltage selection unit.

The display device may include a gate line commonly electrically connected to the first and second sub-pixels to provide a gate signal.

The display device may include first and second data lines alternately electrically connected to the first and second sub-pixels.

A data voltage generated by alternately selecting the first gray scale voltages and the third gray scale voltage may be transmitted to the first data line. A data voltage generated by alternately selecting the second gray scale voltages and the fourth gray scale voltages may be transmitted to the second data line.

The polarity inversion signal may be constantly maintained, and the swap signal may swing for each one horizontal time 1H.

The display device may include first and second data lines respectively electrically connected to the first and second sub-pixels.

A data voltage generated by alternately selecting the first gray scale voltages and the second gray scale voltage may be transmitted to the first data line. A data voltage generated by alternately selecting the third gray scale voltages and the fourth gray scale voltages may be transmitted to the second data line.

The polarity inversion signal may swing for each one horizontal time 1H, and the swap signal may be constantly maintained.

The display device may include first and second gate lines respectively electrically connected to the first and second sub-pixels, and a data line commonly electrically connected to the first and second sub-pixels.

A data voltage generated by alternately selecting the first to fourth gray scale voltages may be transmitted to the data line.

First and second gate signals respectively transmitted to the first and second gate lines may swing for each ½ horizontal time ½H, the polarity inversion signal may swing for each one horizontal time 1H, and the swap signal may swing for each ½ horizontal time ½H.

Another aspect is a driving circuit of a display device, including: a gamma reference voltage generator configured to supply first gamma reference voltages having a high gamma value greater than a reference gamma value, and second gamma reference voltages having a low gamma value smaller than the reference gamma value; a data driver configured to output, to a display panel, a data voltage generated based on any one of the first gamma reference voltages and the second gamma reference voltages; and a driving controller configured to determine the gamma value and output pattern of the data voltage according to a driving method of the display panel.

Another aspect is a display device comprising a display panel, a gamma reference voltage generator, a data driver, and a driving controller. The display panel includes a plurality of pixels, wherein each pixel includes first and second sub-pixels. The gamma reference voltage generator is configured to generate at least one first gamma reference voltage each having a high gamma value greater than a reference gamma value, and at least one second gamma reference voltage each having a low gamma value less than the reference gamma value. The data driver is configured to generate a data voltage based at least in part on one or more of the first and second gamma reference voltages and provide the data voltage to the first and second sub-pixels. The driving controller is configured to determine a gamma value and a data voltage output pattern according to a driving mechanism of the display panel.

In the above display device, the gamma reference voltage generator includes a first gamma reference voltage generator configured to generate the first gamma reference voltage based at least in part on a first driving voltage, and a second gamma reference voltage generator configured to generate the second gamma reference voltage based at least in part on a second driving voltage. In the above display device, the first and second driving voltages have substantially the same voltage level. In the above display device, the first gamma reference voltage comprises a plurality of first gamma reference voltages respectively corresponding to a plurality of inflection points of a high gamma curve, and wherein the second gamma reference voltage comprises a plurality of second gamma reference voltages corresponding to a plurality of inflection points of a low gamma curve.

In the above display device, the reference gamma value is about 2.2. In the above display device, the data driver includes a voltage divider configured to generate a plurality of gray scale voltages based at least in part on a voltage division of the first and second gamma reference voltages. In the above display device, the voltage divider is configured divide the first and second gamma reference voltages into positive and negative gamma reference voltages. In the above display device, the gray scale voltages include a positive first gray scale voltage generated based on a positive first gamma reference voltage, a negative second gray scale voltage generated based on a negative first gamma reference voltage, a positive third gray scale voltage generated based on a positive second gamma reference voltage, and a negative fourth gray scale voltage generated based on a negative second gamma reference voltage.

In the above display device, the voltage divider includes first to fourth sets of resistors respectively configured to generate the first to fourth gray scale voltages. In the above display device, the data driver includes a gray scale voltage selector configured to select and output one or more of the first to fourth gray scale voltages according to a data driving control signal of the driving controller. In the above display device, the data driving control signal includes a polarity inversion signal configured to select the polarity of the data voltage, a swap signal configured to select the gamma value of the data voltage, and a pattern control signal configured to select the data voltage output pattern.

In the above display device, the gray scale selector includes a lookup table in which an output pattern of the gray scale voltages corresponds to combinations of the swap signal and the pattern control signal is listed. In the above display device, the data driver includes a digital-analog converter (DAC) configured to generate an analog data voltage corresponding to a digital image data, based at least in part on the gray scale voltages supplied from the gray scale voltage selector. The above display device further comprises a gate line commonly electrically connected to the first and second sub-pixels to provide a gate signal.

The above display device further comprises first and second data lines alternately electrically connected to the first and second sub-pixels. In the above display device, the data driver is configured to provide a selected one of the first and third gray scale voltages to the first data line, and the data driver is further configured to provide a selected one of the second and fourth gray scale voltages to the second data line. In the above display device, the polarity inversion signal is substantially constantly maintained, and wherein the swap signal is configured to swing for substantially one horizontal time each. The above display device further comprises first and second data lines respectively electrically connected to the first and second sub-pixels.

In the above display device, the data driver is configured to provide a selected one of the first and second gray scale voltages to the first data line, and the data driver is further configured to provide a selected one of the third and fourth gray scale voltages to the second data line. In the above display device, the polarity inversion signal is configured to swing for substantially one horizontal time each, and wherein the swap signal is substantially constantly maintained. The above display device further comprises first and second gate lines respectively electrically connected to the first and second sub-pixels, and a data line commonly electrically connected to the first and second sub-pixels.

In the above display device, the data driver is configured to provide a selected one of the first to fourth gray scale voltages to the data line. The above display device further comprises a gate driver configured to respectively transmit first and second gate signals to the first and second gate lines, wherein the first and second gate signals are configured to swing for substantially ½ horizontal time each, wherein the polarity inversion signal is configured to swing for substantially one horizontal time each, and wherein the swap signal is configured to swing for substantially ½ horizontal time each. In the above display device, the driving mechanism comprises frame inversion, line inversion, or dot inversion, and wherein the driving mechanism is configured to change depending on the structure of the pixel.

Another aspect is a driving circuit of a display device, the driving circuit comprising a gamma reference voltage generator, a data driver, and a driving controller. The gamma reference voltage generator is configured to generate at least one first gamma reference voltage each having a high gamma value greater than a reference gamma value, and at least one second gamma reference voltage each having a low gamma value less than the reference gamma value. The data driver is configured to generate a data voltage based at least in part on one or more of the first and second gamma reference voltages. The driving controller is configured to determine a gamma value and a data voltage output pattern according to a driving mechanism of the display panel.

Another aspect is a display device comprising a display panel, a gamma reference voltage generator, a data driver, and a driving controller. The display panel includes a plurality of pixels, wherein each pixel includes first and second sub-pixels. The gamma reference voltage generator is configured to generate at least one first gamma reference voltage each having a first gamma value and at least one second gamma reference voltage each having a second gamma value, wherein the first and second gamma values are different. The data driver is configured to generate a data voltage based at least in part on one or more of the first and second gamma reference voltages and provide the data voltage to the first and second sub-pixels. The driving controller is configured to determine a gamma value and a data voltage output pattern according to a driving mechanism of the display panel.

Another aspect is a driving circuit for a display device. The driving circuit comprises a gamma reference voltage generator, a data driver, and a driving controller. The gamma reference voltage generator is configured to generate at least one first gamma reference voltage each having a first gamma value and at least one second gamma reference voltage each having a second gamma value, wherein the first and second gamma values are different. The data driver is configured to generate a data voltage based at least in part on one or more of the first and second gamma reference voltages. The driving controller is configured to determine a gamma value and a data voltage output pattern according to a driving mechanism of the display panel.

BRIEF DESCRIPTION OF THE DRAWINGS

Example embodiments will now be described more fully hereinafter with reference to the accompanying drawings; however, they can be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions can be exaggerated for clarity of illustration. It will be understood that when an element is referred to as being "between" two elements, it can be the only element between the two elements, or one or more intervening elements can also be present. Like reference numerals refer to like elements throughout.

FIGS. 4A, 4B and 4C are diagrams illustrating a display panel and a driving method thereof according to a first embodiment.

FIGS. 5A, 5B and 5C are diagrams illustrating a display panel and a driving method thereof according to a second embodiment.

FIGS. 6A, 6B and 6C are diagrams illustrating a display panel and a driving method thereof according to a third embodiment.

DETAILED DESCRIPTION OF CERTAIN INVENTIVE EMBODIMENTS

Figure 1:
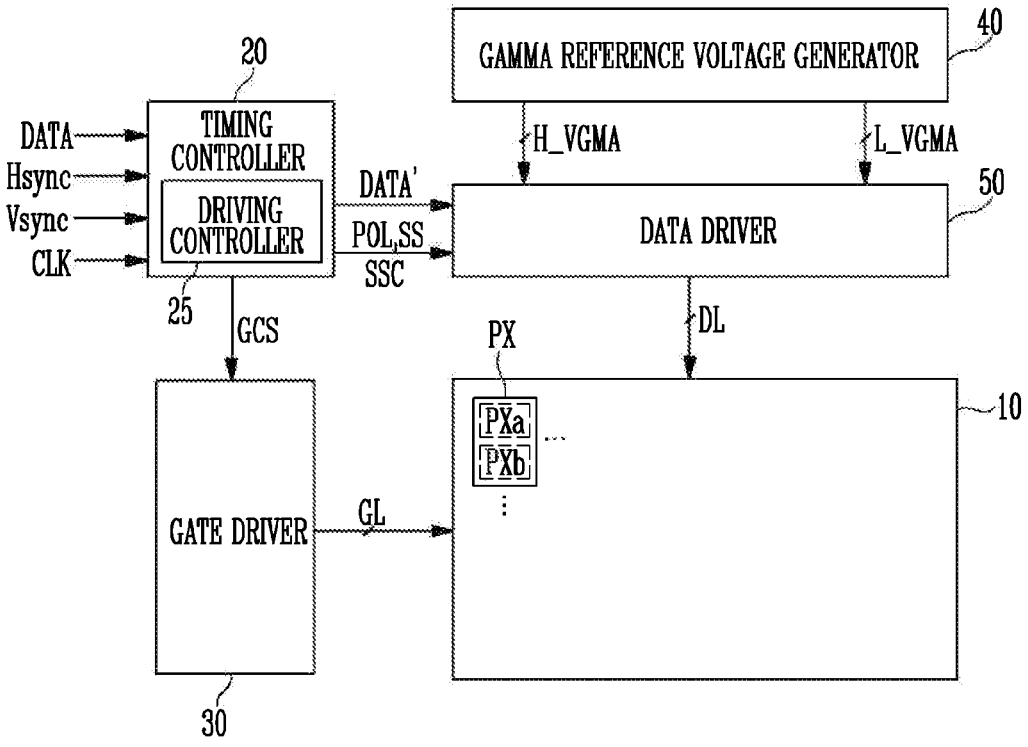
FIG. 1 is a schematic configuration diagram illustrating a display device according to an embodiment.

Hereinafter, certain exemplary embodiments according to the described technology will be described with reference to the accompanying drawings. When a first element is described as being electrically connected to a second element, the first element can be not only directly electrically connected to the second element but can also be indirectly electrically connected to the second element via a third element. Further, some of the elements that are not essential to the complete understanding of the invention are omitted for clarity. Also, like reference numerals refer to like elements throughout.

FIG. 1 is a schematic configuration diagram illustrating a display device according to an embodiment, Referring to FIG. 1, the display device can include a display panel 10, a timing controller 20, a gate driver 30, a gamma reference voltage generator 40 and a data driver 50.

The display panel 10 includes a plurality of gate lines GL formed in a row direction to provide a gate signal, a plurality of data lines DL formed in a column direction to provide a data voltage, and a plurality of pixels PX electrically connected to the gate lines GL and the data lines DL. The pixels PX are arranged in a matrix form. Each pixel PX includes a pair of first and second sub-pixels PXa and PXb. A data voltage having a high gamma value (hereinafter, referred to as a high data voltage) is applied to the first sub-pixel PXa. A data voltage having a low gamma value (hereinafter, referred to a low data voltage) is applied to the second sub-pixel PXb. Thus, the arrangement directions of liquid crystal molecules of the two sub-pixels PXa and PXb are different from each other, thereby improving visibility in left and right viewing angles.

In the present embodiment, the display panel 10 is a liquid crystal display (LCD) panel in which each sub-pixel PXa or PXb includes a thin film transistor (TFT; not shown) electrically connected to gate and data lines GL and DL, and a pixel electrode (not shown) electrically connected to the TFT. The on/off state of the TFT is controlled by a gate signal applied from the gate line GL. The TFT receives a data voltage (or data signal) applied from the data line DL to provide the data voltage to the pixel electrode. Accordingly, it is possible to display an image by controlling the placement of liquid crystal molecules.

The structure and driving method or driving mechanism of the display panel 10 can vary. For example, in the display panel 10 with a 1G2D structure, the sub-pixels PXa and PXb are commonly electrically connected to one gate line GL, and are respectively electrically connected to two different data lines DL. In the display with a 2G1D structure, the sub-pixels PXa and PXb are respectively electrically connected to two different gate lines GL, and are commonly electrically connected to one data line DL. The display panel 10 can include various inversion driving methods such as frame inversion, line inversion and dot inversion. The driving method can be changed depending on the 1G2D or 2G1D structure.

The timing controller 20 receives an image data DATA from an external image source and input control signals for controlling the display of the image data, e.g., a horizontal synchronization signal Hsync, a vertical synchronization signal Vsync, a clock signal CLK, and the like. The timing controller 20 can generate an image data DATA' by processing the image data DATA, and provide the generated image data DATA' to the data driver 50. The timing controller 20 can generate and output a gate driving control signal GCS for controlling the gate driver 30 and data driving control signals POL, SS and SSC for controlling the data driver 50, based on the input control signals.

The gate driver 30 is electrically connected to the gate lines GL. The gate driver 30 generates a gate signal in response to the gate driving control signal GCS, and outputs the generated gate signal to the gate lines GL. Pixels PX for each row are substantially sequentially selected according to the gate signal so that the data voltage can be provided to the pixels PX. The gate driver 30 can supply a gate signal which swings approximately every one horizontal time 1H according to a predetermined scan frequency, and the scan frequency can be controlled by the timing controller 20.

The gamma reference voltage generator 40 supplies first gamma reference voltages H_VGMA having a high gamma value greater than a reference gamma value, and second gamma reference voltages L_VGMA having a low gamma value less than the reference gamma value. The reference gamma value can be about 2.2, and vary according to a user's setting. The first gamma reference voltages H_VGMA correspond to the high data voltage applied to the first sub-pixel PXa. The second gamma reference voltages L_VGMA correspond to the low data voltage applied to the second sub-pixel PXb. That is, the gamma reference voltage generator 40 can apply different data voltages to the two sub-pixels PXa and PXb by making gamma reference voltage sets or gray scale voltage sets. The gamma reference or gray scale voltage sets correspond to the respective two sub-pixels PXa and PXb. The gamma reference voltage generator 40 can alternately provide the gamma reference voltage sets or gray scale voltage sets to the data driver 50 or allow the data driver 50 to alternately select the gamma reference voltage sets or gray scale voltage sets. For example, the gamma value of the gamma reference voltages H_VGMA or L_VGMA are set so that a synthesis of gamma curves of the two sub-pixels PXa and PXb approaches a reference gamma curve at a front view.

The data driver 50 is electrically connected to the data lines DL. The data driver 50 generates a data voltage in response to the data driving control signals POL, SS and SSC, and outputs the generated data voltage to the data lines DL. The data driver 50 converts the digital image data DATA' into an analog data voltage, and outputs the converted analog data voltage to the data lines DL.

The data driver 50 receives the gamma reference voltages H_VGMA or L_VGMA, and generates the data voltage, based on the gamma reference voltages H_VGMA or L_VGMA. For example, the gamma reference voltage generator 40 provides the gamma reference voltages H_VGMA or L_VGMA having a predetermined number corresponding to inflection points of the gamma curve, and generates gray scale voltages for all gray scales by dividing the gamma reference voltages H_VGMA or L_VGMA. The data driver 50 selects the data voltage according to the data driving control signals POL, SS and SSC among the gray scale voltages. The data driver 50 sequentially provides the data voltage to pixels PX for each row in the display panel 10. The data voltages applied to the pair of sub-pixels PXa and PXb can have different gamma values.

The gamma value and data voltage output pattern can change depending on the structure and driving method. For example, in the display panel with the 1G2D structure, the data voltage is substantially simultaneously applied to the sub-pixels PXa and PXb. In the display panel with the 2G1D structure, the data voltage is substantially sequentially applied to the sub-pixels PXa and PXb approximately every ½ horizontal time ½H. Commonly, in the display panel, data voltages having different polarities are applied to adjacent data lines DL, and the polarity can be inverted substantially every frame. The driving of the data driver 50 will be described in detail with reference to FIG. 3.

Meanwhile, the timing controller 20 can include a driving controller 25 that determines the gamma value and data voltage output pattern. The driving method of the display panel or the gamma value and data voltage output pattern can be previously set before a product is released. For example, the driving controller 25 can determine the gamma value and data voltage output pattern according to the driving method of the display panel with reference to a predetermined numerical formula, histogram, lookup table, or the like.

The driving controller 25 can output data driving control signals POL, SS and SSC. The data driving control signals POL, SS and SSC can include a polarity inversion signal POL for selecting the polarity of the data voltage, a swap signal SS for selecting the gamma value of the data voltage, and a pattern control signal SSC for selecting the data voltage output pattern. For example, the driving controller 25 can receive information on which structure (e.g., 1G2D, 2G1D, 1G1D) the display panel 10 has and which inversion driving method the display panel 10 has, to output a combination of the data driving control signals POL, SS and SSC. Therefore, the gamma value and data voltage output pattern (e.g., polarity inversion, output timing, repetitive pattern and the like) can be controlled by the data driving control signals POL, SS and SSC.

Each of the timing controller 20, the gamma reference voltage generator 40 and the drivers 30 and 50 can be mounted in at least one integrated circuit chip on the display panel 10, attached in, for example, a tape carrier package (TCP) to the display panel 10 by being mounted on a flexible printed circuit board (not shown), or mounted on a separate printed circuit board (not shown).

Figure 2A:
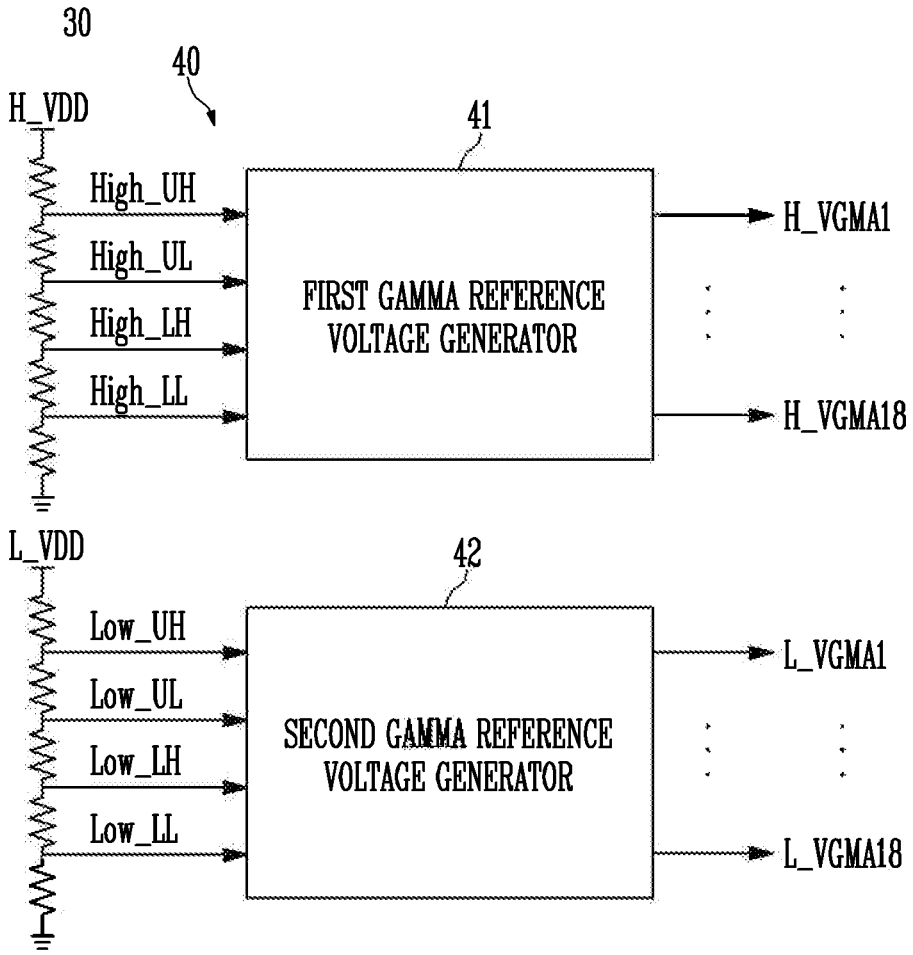
FIG. 2A is a configuration diagram illustrating an embodiment of a gamma reference voltage generator shown in FIG. 1.
Figure 2B:
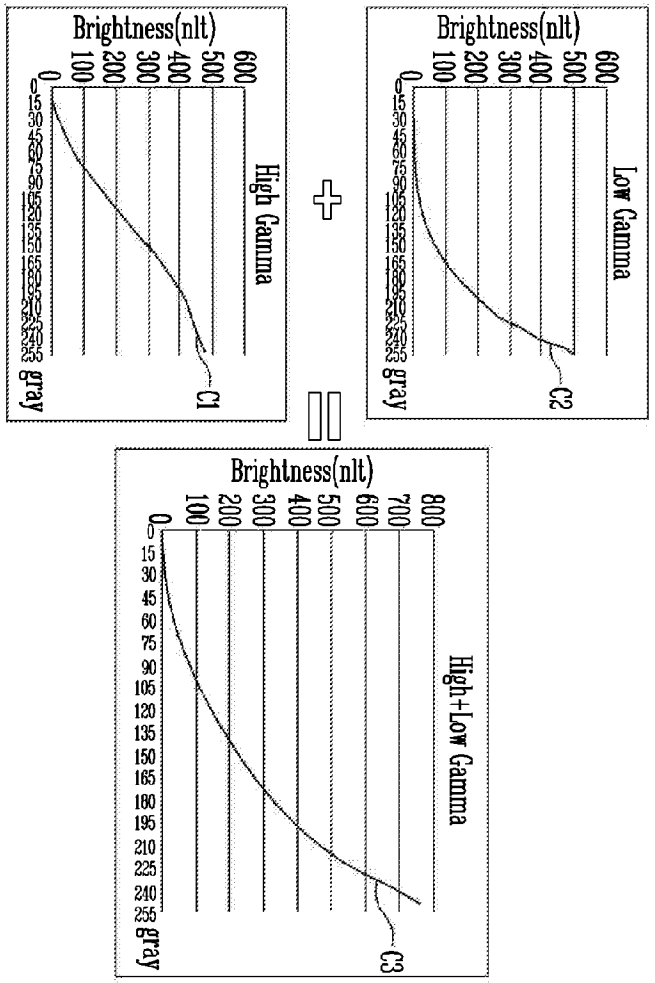
FIG. 2B is a graph illustrating first and second gamma reference voltages.

FIG. 2A is a configuration diagram illustrating an embodiment of the gamma reference voltage generator 40 shown in FIG. 1. FIG. 2B is a graph illustrating first and second gamma reference voltages.

Referring to FIGS. 2A and 2B, the gamma reference voltage generator 40 can include the first and second gamma reference voltage generators 41 and 42. The first gamma reference voltage generator 41 generates first gamma reference voltages H_VGMA from a first driving voltage H_VDD. The second gamma reference voltage generator 42 generates second gamma reference voltages L_VGMA from a second driving voltage L_VDD. The first gamma reference voltages H_VGMA correspond to inflection points of a high gamma curve C1, and the second gamma reference voltages L_VGMA correspond to inflection points of a low gamma curve C2. The high data voltage is applied to the first sub-pixel PXa, and the low data voltage is applied to the second sub-pixel PXb. A synthetic gamma curve C3 of the high and low gamma curves C1 and C2 becomes the reference gamma curve at a front view. The reference gamma value of the reference gamma curve can be about 2.2, but is not limited thereto.

The first and second driving voltages H_VDD and L_VDD can be supplied from a predetermined power unit (not shown), and the power unit can be included in the timing controller 20. The first and second driving voltages H_VDD and L_VDD can have substantially the same voltage level. The first and second driving voltages H_VDD and L_VDD can be provided by being divided into a plurality of voltages between high-potential and low-potential driving voltages High_UH, High_UL, High_LH, High_LL, Low_UH, Low_UL, Low_LH, and Low_LL.

The first gamma reference generator 41 generates a plurality of first gamma reference voltages H_VGMA from the first driving voltage H_VDD with reference to a gamma reference voltage lookup table (not shown), and outputs the generated first gamma reference voltages H_VGMA to the data driver 50. The second gamma reference generator 42 generates a plurality of second gamma reference voltages L_VGMA from the second driving voltage L_VDD with reference to the gamma reference voltage lookup table, and outputs the generated second gamma reference voltages L_VGMA to the data driver 50. When the reference gamma value is changed, the high and low gamma values can also be changed.

Each of the first and second gamma reference voltages H_VGMA and L_VGMA can be divided into positive and negative gamma reference voltages, based on a common voltage supplied from the display panel 10. For example, among the first gamma reference voltages H_VGMA, first gamma reference voltages H_VGMA1 to H_VGMA9 in an upper group can be positive gamma reference voltages. Furthermore, first gamma reference voltages H_VGMA10 to H_VGMA18 in a lower group can be negative gamma reference voltages. Among the second gamma reference voltages L_VGMA, second gamma reference voltages L_VGMA1 to L_VGMA9 in an upper group can be positive gamma reference voltages, and first gamma reference voltages L_VGMA10 to L_VGMA18 in a lower group can be negative gamma reference voltages.

Figure 3:
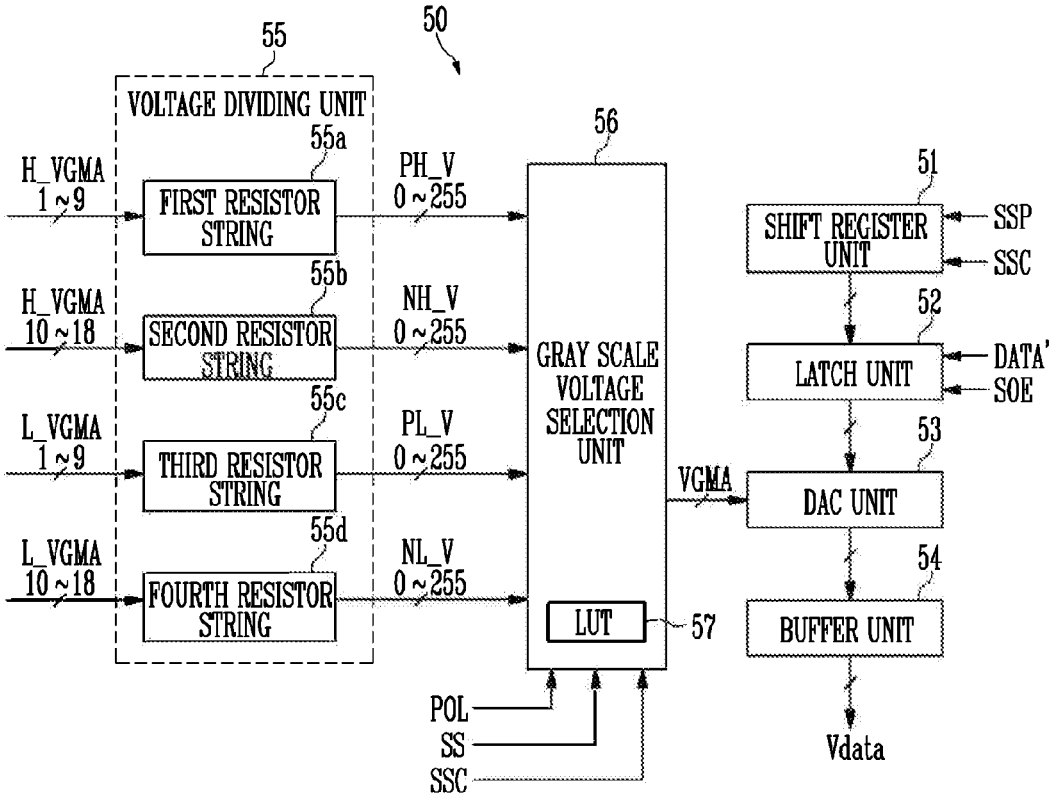
FIG. 3 is a configuration diagram illustrating an embodiment of a data driver shown in FIG. 1.

FIG. 3 is a configuration diagram illustrating an embodiment of the data driver 50 shown in FIG. 1.

Referring to FIG. 3, the data driver 50 can include a shift register unit 51, a latch unit 52, a digital-analog converter (DAC) unit or DAC 53, a buffer unit 54, a voltage dividing unit or voltage divider 55 and a gray scale voltage selection unit or gray scale voltage selector 56.

The shift register unit 51 substantially sequentially generates a sampling signal in one horizontal time while shifting the source start pulse SSP provided from the timing controller 50 according to the pattern control signal SSC. The shift register unit 51 can include a plurality of shift registers (not shown).

The latch unit 52 can include a first latch unit (not shown) configured to substantially sequentially latch the image data DATA', in response to the sampling signal provided from the shift register unit 51. The latch unit 52 can also include a second latch unit (not shown) configured to perform a parallel latch operation on a data for one horizontal line at a rising time of a source output enable signal SOE and supply the parallel latched data to the DAC unit 53.

When the image data DATA' is input, the DAC unit 53 generates an analog image data voltage corresponding to the digital image data DATA' and outputs the generated analog image data voltage to the buffer unit 54. The DAC unit 53 receives gray scale voltages VGMA supplied from the gray scale voltage selection unit 56, to generate a plurality of data voltages Vdata, corresponding to the image data DATA', The DAC unit 53 can include a plurality of DACs.

The buffer unit 54 supplies the data voltages Vdata to the respective data lines DL. The buffer unit 54 includes a plurality of output buffers (not shown) respectively electrically connected to the data lines DL, and the output buffers can be configured with an operating amplifier (not shown).

The voltage dividing unit 55 generates a plurality of gray scale voltages PH_V, NH_V, PL_V and NL_V by voltage-dividing the first and second gamma reference voltages H_VGMA and L_VGMA. The voltage dividing unit 55 can generate sets of the respective gray scale voltages PH_V, NH_V, PL_V and NL_V by dividing the first and second gamma reference voltages H_VGMA and L_VGMA, using a plurality of resistive elements electrically connected in series (or R-string). For example, the voltage dividing unit 55 can separately produce and output a set of gray scale voltages PH_V and NH_V for generating the high data voltage and a set of gray scale voltages PL_V and NL_V for generating the low data voltage. The voltage dividing unit 55 can include first to fourth R-strings 55*a*, 55*b*, 55*c* and 55*d* for generating first to fourth gray scale voltages PH_V, NH_V, PL_V and NL_V.

For example, the first R-string 55*a* can output positive first gray scale voltages PH_V0 to PH_V255 by dividing the positive first gamma reference voltages H_VGMA1 to H_VGMA9. The second R-string 55*b* can output negative second gray scale voltages NH_V0 to NH_V255 by dividing the negative first gamma reference voltages H_VGMA10 to H_VGMA18. The third R-string 55*c* can output positive third gray scale voltages PL_V0 to PL_V255 by dividing the positive second gamma reference voltages L_VGMA1 to L_VGMA9. The fourth R-string 55*d* can output negative fourth gray scale voltages NL_V0 to NL_V255 by dividing the negative second gamma reference voltages L_VGMA10 to L_VGMA18.

The gray scale voltage selection unit 56 selects one or more of the first to fourth gray scale voltages PH_V, NH_V, PL_V and NL_V according to the data driving control signals POL, SS and SSC, and outputs the selected gray scale voltage to the DAC unit 53.

The gray scale selection unit 56 can include a lookup table (or LUT) 57 in which the data voltage output pattern corresponds to combinations of the swap signal SS and the pattern control signal SSC, as shown in the following Table 1. Furthermore, outputs of the first to fourth data lines D1 to D4 are repeated in data lines after the fourth data line D4, and therefore, their outputs will be omitted.

TABLE 1

| SS | SSC | D1 | D2 | D3 | D4 | Dm |
|---|---|---|---|---|---|---|
| H | 00 | High Gamma | High Gamma | High Gamma | High Gamma | . . . |
| | 01 | High Gamma | Low Gamma | High Gamma | Low Gamma | . . . |
| | 10 | High Gamma | High Gamma | Low Gamma | Low Gamma | . . . |

TABLE 1-continued

| SS | SSC | D1 | D2 | D3 | D4 | Dm |
|---|---|---|---|---|---|---|
| | 11 | High Gamma | Low Gamma | Low Gamma | High Gamma | . . . |
| L | 00 | Low Gamma | Low Gamma | Low Gamma | Low Gamma | . . . |
| | 01 | Low Gamma | High Gamma | Low Gamma | High Gamma | . . . |
| | 10 | Low Gamma | Low Gamma | High Gamma | High Gamma | . . . |
| | 11 | Low Gamma | High Gamma | Low Gamma | High Gamma | . . . |

Referring to Table 1, when the swap signal SS has a high level and the pattern control signal SSC has a value of '00', the high data voltage is output from all the data lines D1 to Dm. The gray scale selection unit 56 selects first or second gray scale voltages PH_V or NH_V corresponding to the high gamma value, and outputs the selected first or second gray scale voltages PH_V or NH_V to the DAC unit 53. When the swap signal has a high level and the pattern control signal SSC has a value of '11', the low data voltage is output to the first and fourth data lines D1 and D4, and the high data voltage is output to the second and third data lines D2 and D3. The gray scale voltage selection unit 56 substantially sequentially outputs the first or second gray scale voltages PH_V or NH_V and the third or fourth gray scale voltages PL_V or NL_V to the DAC unit 53.

Furthermore, the gamma reference voltage generator 40 and the data driver 50 are not limited to the aforementioned structure, and can be modified into various structures in which the gamma value and data voltage output pattern can be changed.

FIGS. 4A, 4B and 4C are diagrams illustrating a display panel 101 and a driving method thereof according to a first embodiment.

Referring to FIG. 4A, the display panel 101 with a 1G2D column inversion structure is driven so that pixels have different polarities for adjacent data lines. The sub-pixels PXa and PXb of the display panel 101 are commonly electrically connected to one gate line, and are respectively electrically connected to two different data lines. Here, the data lines are alternately electrically connected to the first and second sub-pixels PXa and PXb.

In the sub-pixels PXa and PXb, red, green and blue sub-pixels can be regularly repeated along the row direction, and substantially the same form can be repeated along the column direction. Furthermore, the arrangement of the sub-pixels PXa and PXb can vary. The area of the first sub-pixel PXa receiving the high data voltage can be less than that of the second sub-pixel PXb, so that it is possible to reduce distortion of the synthetic gamma curve at a side view.

Hereinafter, in the display panel 101 of the first embodiment, a first data voltage output pattern according to the data driving control signals POL, SS and SSC and a method of selecting gray scale voltages for the purpose of the output patterns will be described.

Referring to FIGS. 4B and 4C, the polarity inversion signal POL is substantially constantly maintained and the swap signal SS swings for substantially one horizontal time 1H each. However, the gate signal swings for substantially one horizontal time 1H each, and the pattern control signal SSC is substantially maintained as the value of '11' The output pattern of FIG. 4C can be set with reference to Table 1 described above.

When the swap signal SS has the high level, the positive high data voltage is output to the first data line D1, the negative low data voltage is output to the second data line D2, the positive low data voltage is output to the third data line D3, and the negative high data voltage is output to the fourth data line D4. The outputs from the first data line D1 to the fourth data line D4 can be repeated in data lines after the fourth data line D4. When the swap signal SS has the low level, the positive low data voltage is output to the first data line D1, the negative high data voltage is output to the second data line D2, the positive high data voltage is output to the third data line D3, and the negative low data voltage is output to the fourth data line D4.

In some embodiments, in the data driver 50, the data voltage Vdata generated by alternately selecting the first gray scale voltages PH_V0 to PH_V255 and the third gray scale voltages PL_V0 to PL_V255 in an N-th gate line Gate N is output to odd-numbered data lines D1, D3, . . . . The data voltage Vdata generated by alternately selecting the second gray scale voltages NH_V0 to NH_V255 and the fourth gray scale voltages NL_V0 to NL_V255 in the N-th gate line Gate N can be output to even-numbered data lines D2, D4, . . . . The polarity of the data voltage Vdata described above is inverted and repeated in an (N+1)-th gate line Gate N+1.

FIGS. 5A, 5B and 5C are diagrams illustrating a display panel and a driving method thereof according to a second embodiment.

Referring to FIG. 5A, the display panel 102 with a 1G2D dot inversion structure is driven so that pixels have different polarities for adjacent data lines and each gate line. The sub-pixels PXa and PXb of the display panel 102 are commonly electrically connected to one gate line, and are respectively electrically connected to two different data lines. Here, the data lines are electrically connected to any one of the first and second pixels PXa and PXb.

Hereinafter, in the display panel 102 of the second embodiment, a second data voltage output pattern according to the data driving control signals POL, SS and SSC and a method of selecting gray scale voltages for the purpose of the output patterns will be described.

Referring to FIGS. 5B and 5C, the polarity inversion signal POL swings for substantially one horizontal time 1H each and the swap signal SS is substantially constantly maintained. However, the gate signal swings for substantially one horizontal time 1H each, and the pattern control signal SSC is substantially maintained as the value of '11'. The output pattern of FIG. 5C can be set with reference to Table 1 described above.

When the polarity inversion signal POL has the high level, the positive high data voltage is output to the first data line D1, the negative low data voltage is output to the second data line D2, the positive low data voltage is output to the third data line D3, and the negative high data voltage is output to the fourth data line D4. The outputs from the first data line D1 to the fourth data line D4 are repeated in data lines after the fourth data line D4. When the polarity inversion signal POL has the low level, the negative high data voltage is output to the first data line D1, the positive low data voltage is output to the second data line D2, the negative low data voltage is output to the third data line D3, and the positive high data voltage is output to the fourth data line D4.

In some embodiments, in the data driver 50, the data voltage Vdata generated by alternately selecting the first gray scale voltages PH_V0 to PH_V255 and the second gray scale voltages NH_V0 to NH_V255 in the N-th gate line Gate N is output to odd-numbered data lines D1, D3, . . . . The data voltage Vdata generated by alternately selecting the third gray scale voltages PL_V0 to PL_V255 and the fourth gray scale voltages NL_V0 to NL_V255 in the N-th gate line Gate N can be output to even-numbered data lines D2, D4, . . . . The polarity of the data voltage Vdata described above is inverted and repeated in the (N+1)-th gate line Gate N+1.

FIGS. 6A, 6B and 6C are diagrams illustrating a display panel 103 and a driving method thereof according to a third embodiment.

Referring to FIG. 6A, the display panel 103 with a 2G1D dot inversion structure is driven so that pixels have different polarities for adjacent data lines and each gate line. The sub-pixels PXa and PXb of the display panel 103 are commonly electrically connected to one data line, and are respectively electrically connected two different gate lines. Here, odd-numbered gate lines Gate N, Gate N+2, . . . are electrically connected to the first sub-pixel PXa, and even-numbered gate lines Gate N+1, Gate N+3, . . . are electrically connected to the second sub-pixel PXb.

Hereinafter, in the display panel 103 of the third embodiment, a third data voltage output pattern according to the data driving control signals POL, SS and SSC and a method of selecting gray scale voltages for the purpose of the output patterns will be described.

Referring to FIGS. 6B and 6C, it is assumed that the polarity inversion signal POL swings for substantially one horizontal time 1H each and the swap signal SS swings for substantially ½ horizontal time ½H each. Furthermore, a first gate signal gate odd transmitted to the odd-numbered gate lines Gate N, Gate N+2, . . . and a second gate signal gate even transmitted to the even-numbered gate lines Gate N+1, Gate N+3, . . . swing for each ½ horizontal time ½H, and the pattern control signal SSC is substantially maintained as the value of '00'. The output pattern of FIG. 6C can be set with reference to Table 1 described above.

When the polarity inversion signal POL and the swap signal SS have the high level, the positive high data voltage and the negative high data voltage are alternately applied to the data lines. When the polarity inversion signal POL has the high level and the swap signal SS has the low level, the positive low data voltage and the negative low data voltage are alternately applied to the data lines. When the polarity inversion signal POL and the swap signal SS have the low level, the negative low data voltage and the positive low data voltage are alternately applied to the data lines. When the polarity inversion signal POL has the low level and the swap signal SS has the high level, the negative high voltage level and the positive high voltage level are alternately applied to the data lines.

In some embodiments, in the data driver 50, different data voltages Vdata generated by alternately applying the first to fourth gray scale voltages PH_V, NH_V, PL_V and NL_V from the N-th gate line Gate N to the (N+3)-th gate line Gate N+3 are sequentially output to the first to fourth data lines D1 to D4. The output pattern described above is repeated in gate lines after the (N+3)-th gate line Gate N+3.

The display panel with the 1G2D structure and the display panel with the 2G1D structure have different driving methods, different kinds of gamma reference voltage generators and different gamma tuning methods. Therefore, the display panels are provided with different driving circuits. Particularly, in the 1G2D structure, the luminance is controlled through only conversion of an image data in a state in which the gamma reference voltages of high and low data voltages are equal to each other. Therefore, the accuracy of gamma tuning may be lowered.

According to at least one of the disclosed embodiments, the gamma value and output pattern of the data voltage are determined according to the driving method of the display panel. The data voltage according to the driving method of the display panel is selectively output to the sub-pixel. Therefore, the described technology provides a display device in which the setting of appropriate gamma tuning and driving method is possible according to the driving method of the display panel and a driving circuit which can commonly be used in display panels having different driving methods.

Furthermore, the gamma reference voltages having the high gamma value and the gamma reference voltages having the low gamma value are independently generated, and the high and low data voltages are generated based on the generated gamma reference voltages, thereby improving the accuracy of gamma tuning.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment can be used singly or in combination with features, characteristics, and/or elements described in connection with other embodiments unless otherwise specifically indicated. Accordingly, it will be understood by those of skill in the art that various changes in form and details can be made without departing from the spirit and scope of the described technology as set forth in the following claims.

What is claimed is:

1. A display device, comprising:

a display panel including a plurality of pixels, wherein each pixel includes first and second sub-pixels;

a gamma reference voltage generator configured to generate at least one first gamma reference voltage each having a high gamma value greater than a reference gamma value, and at least one second gamma reference voltage each having a low gamma value less than the reference gamma value;

a data driver configured to i) generate a data voltage based at least in part on one or more of the first and second gamma reference voltages and ii) provide the data voltage to the first and second sub-pixels; and a driving controller configured to determine a gamma value and a data voltage output pattern according to a driving mechanism of the display panel, wherein the data driver includes a voltage divider configured to generate a plurality of gray scale voltages based at least in part on a voltage division of the first and second gamma reference voltages, wherein the voltage divider is configured to divide the first and second gamma reference voltages into positive and negative gamma reference voltages, and wherein the gray scale voltages include i) a positive first gray scale voltage generated based on a positive first gamma reference voltage, ii) a negative second gray scale voltage generated based on a negative first gamma reference voltage, iii) a positive third gray scale voltage generated based on a positive second gamma reference voltage, and iv) a negative fourth gray scale voltage generated based on a negative second gamma reference voltage.

2. The display device of claim 1, wherein the gamma reference voltage generator includes a first gamma reference voltage generator configured to generate the first gamma reference voltage based at least in part on a first driving voltage, and a second gamma reference voltage generator configured to generate the second gamma reference voltage based at least in part on a second driving voltage.

3. The display device of claim 2, wherein the first gamma reference voltage comprises a plurality of first gamma reference voltages respectively corresponding to a plurality of inflection points of a high gamma curve, and wherein the second gamma reference voltage comprises a plurality of second gamma reference voltages corresponding to a plurality of inflection points of a low gamma curve.

4. The display device of claim 2, wherein the reference gamma value is about 2.2.

5. The display device of claim 1, wherein the data driver includes a gray scale voltage selector configured to select and output one or more of the first to fourth gray scale voltages according to a data driving control signal of the driving controller.

6. The display device of claim 5, wherein the data driving control signal includes i) a polarity inversion signal configured to select the polarity of the data voltage, ii) a swap signal configured to select the gamma value of the data voltage, and iii) a pattern control signal configured to select the data voltage output pattern.

7. The display device of claim 6, wherein the gray scale selector includes a lookup table in which an output pattern of the gray scale voltages corresponds to combinations of the swap signal and the pattern control signal is listed.

8. The display device of claim 6, further comprising a gate line commonly electrically connected to the first and second sub-pixels to provide a gate signal.

9. The display device of claim 8, further comprising first and second data lines alternately electrically connected to the first and second sub-pixels.

10. The display device of claim 9, wherein the data driver is configured to provide a selected one of the first and third gray scale voltages to the first data line, and wherein the data driver is further configured to provide a selected one of the second and fourth gray scale voltages to the second data line.

11. The display device of claim 10, wherein the polarity inversion signal is substantially constantly maintained, and wherein the swap signal is configured to swing for substantially one horizontal time each.

12. The display device of claim 8, further comprising first and second data lines respectively electrically connected to the first and second sub-pixels.

13. The display device of claim 12, wherein the data driver is configured to provide a selected one of the first and second gray scale voltages to the first data line, and wherein the data driver is further configured to provide a selected one of the third and fourth gray scale voltages to the second data line.

14. The display device of claim 13, wherein the polarity inversion signal is configured to swing for substantially one horizontal time each, and wherein the swap signal is substantially constantly maintained.

15. The display device of claim 6, further comprising first and second gate lines respectively electrically connected to the first and second sub-pixels, and a data line commonly electrically connected to the first and second sub-pixels.

16. The display device of claim 15, wherein the data driver is configured to provide a selected one of the first to fourth gray scale voltages to the data line.

17. The display device of claim 16, further comprising a gate driver configured to respectively transmit first and second gate signals to the first and second gate lines, wherein the first and second gate signals are configured to swing for substantially ½ horizontal time each, wherein the polarity inversion signal is configured to swing for substantially one horizontal time each, and wherein the swap signal is configured to swing for substantially ½ horizontal time each.

18. The display device of claim 1, wherein the data driver further includes a gray scale voltage selector configured to receive the gray scale voltages and select one or more of the gray scale voltages based on a plurality of control signals, and wherein at least one of the selected gray scale voltages has a different polarity than one of the other selected gray scale voltages.

19. A driving circuit of a display device, comprising:

a gamma reference voltage generator configured to generate at least one first gamma reference voltage each having a high gamma value greater than a reference gamma value, and at least one second gamma reference voltage each having a low gamma value less than the reference gamma value;

a data driver configured to generate a data voltage based at least in part on one or more of the first and second gamma reference voltages; and a driving controller configured to determine a gamma value and a data voltage output pattern according to a driving mechanism of the display panel, wherein the data driver includes a voltage divider configured to generate a plurality of gray scale voltages based at least in part on a voltage division of the first and second gamma reference voltages, and wherein the data driver is further configured to generate the data voltage based on the gray scale voltages, wherein the voltage divider is configured to divide the first and second gamma reference voltages into positive and negative gamma reference voltages, and wherein the gray scale voltages include i) a positive first gray scale voltage generated based on a positive first gamma reference voltage, ii) a negative second gray scale voltage generated based on a negative first gamma reference voltage, iii) a positive third gray scale voltage generated based on a positive second gamma reference voltage, and iv) a negative fourth gray scale voltage generated based on a negative second gamma reference voltage.

* * * * *